US007382893B2

(12) United States Patent
Baeten

(10) Patent No.: US 7,382,893 B2
(45) Date of Patent: Jun. 3, 2008

(54) LOUDSPEAKER WITH INVERTED CONE

(75) Inventor: Jozef Arnold Frans Baeten, Dendermonde (BE)

(73) Assignee: PSS Belgium N.V., Dendermonde (BE)

( * ) Notice: Subject to any disclaimer, the term of this patent is extended or adjusted under 35 U.S.C. 154(b) by 303 days.

(21) Appl. No.: 10/524,401

(22) PCT Filed: Jul. 31, 2003

(86) PCT No.: PCT/IB03/03402

§ 371 (c)(1),
(2), (4) Date: Feb. 11, 2005

(87) PCT Pub. No.: WO2004/017674

PCT Pub. Date: Feb. 26, 2004

(65) Prior Publication Data

US 2005/0238187 A1 Oct. 27, 2005

(30) Foreign Application Priority Data

Aug. 16, 2002 (EP) ..... 02078392

(51) Int. Cl.
*H04R 9/04* (2006.01)
*H04R 1/02* (2006.01)

(52) U.S. Cl. ..... 381/416; 381/412

(58) Field of Classification Search ..... 381/396, 381/403, 404, 407, 412, 416, 419, 420, 432, 381/162, 400, 423
See application file for complete search history.

(56) References Cited

U.S. PATENT DOCUMENTS 4,737,992 A * 4/1988 Latham-Brown et al. ... 381/404
5,625,701 A * 4/1997 Scanlan ..... 381/403
5,802,191 A * 9/1998 Guenther ..... 381/386
5,920,638 A * 7/1999 Tsai ..... 381/397
6,327,372 B1 * 12/2001 Devantier et al. ..... 381/426
6,836,551 B2 * 12/2004 Kuze et al. ..... 381/412
2002/0094105 A1 * 7/2002 Boniface ..... 381/397
2003/0081808 A1 * 5/2003 Kemmerer ..... 381/397

FOREIGN PATENT DOCUMENTS

GB 2360899 10/2001

OTHER PUBLICATIONS

John Borwick, "Loudspeaker and Headphone Handbook", Mar. 2001, Focal Press, 3 edition, p. 501.*
Leo L. Beranek, Acoustics, ISBN 0-88318-494-X, pp. 70 to 75.
Leo L. Beranek, Acoustics, ISBN 0-88318-494-X, pp. 183 to 200.

* cited by examiner

*Primary Examiner*—Brian Ensey
(74) *Attorney, Agent, or Firm*—Peter A. Nieves; Sheehan, Phinney, Bass + Green, P.A.

(57) ABSTRACT

The movable structure of a loudspeaker is configured to include a bridging element that connects the base of a diaphragm to an electromagnetic actuator. The bridging element extends radially with respect to the translation axis of the actuator and secures the diaphragm at a radial distance from the actuator, thereby increasing the base part of the diaphragm. This increased base area allows the translatable part of the actuator to be shortened, thereby providing high-performance in structures of limited depth.

21 Claims, 2 Drawing Sheets

LOUDSPEAKER WITH INVERTED CONE

Figure 1:
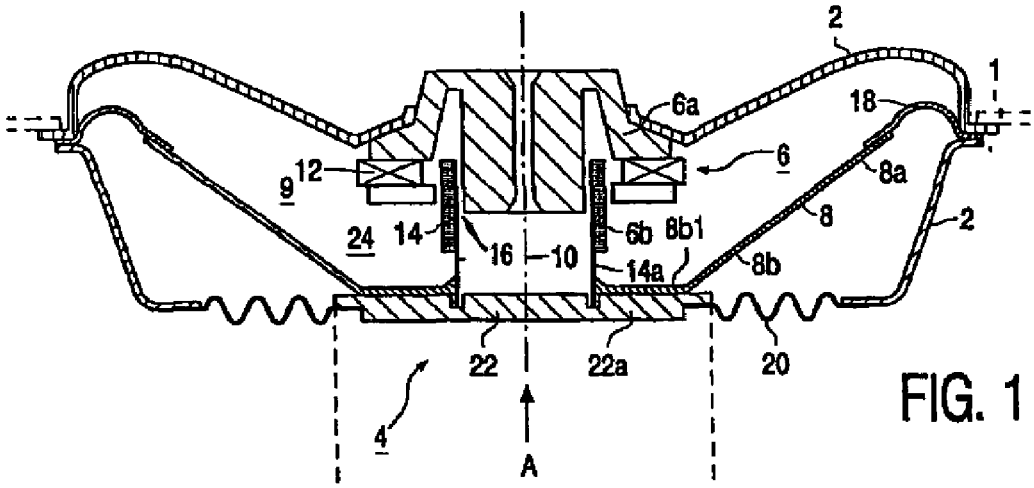

The invention relates to an electrodynamic loudspeaker comprising a chassis, a movable body flexibly connected to the chassis and having a three-dimensional diaphragm with a base part and a top part which is wider than the base part, and an electromagnetic actuator for moving said body with respect to the chassis along a translation axis extending between said two parts of the diaphragm, which actuator comprises a stationary actuator part secured to the chassis and a translatable actuator part, which latter part substantially extends inside the space enveloped by the contours of the diaphragm and which latter part is translatable along the translation axis with respect to the stationary actuator part and is connected to the movable body in the region of the base part of the diaphragm, said actuator parts being capable of magnetically co-operating with each other across an air gap. Thus the invention relates to a so-called inverted loudspeaker.

GB-A 2 360 899 discloses an inverted coaxial speaker for use in automobile doors and similar thin structures. This known speaker has a frame, an electromagnetic actuator, and a frustoconical speaker cone. This cone has an outer perimeter secured via a roll section to the frame and an inner perimeter secured to one end of a cylindrical coil former of the actuator, a flexible corrugated suspension member extending between this end and the frame. The other end of the coil former extends into an annular gap of a magnetic yoke fixed to the frame and carries a voice coil.

Although the known inverted speaker has a smaller axial dimension than generally known conventional speakers in which the actuator is situated behind a backplane of the speaker cone, the known inverted speaker has still a relatively great height owing to the required relatively long voice coil former.

It is an object of the invention to improve the loudspeaker as defined in the preamble in such a way that a very small height is within reach.

According to the invention, this object is achieved with the loudspeaker which is characterized in that the movable body comprises, in the proximity of the base part of the diaphragm, a bridging element which is secured to the movable part of the actuator and extends radially with respect to the translation axis, the diaphragm and the bridging element being interconnected at least at a radial distance to the translatable part of the actuator.

Due to the characteristic features described above, the base part of the diaphragm needs not to be fastened to the translatable part of the actuator, but is secured to the bridging element and is thus indirectly connected to the translatable part. In consequence of this, the width of the base part is greater than the corresponding dimension of the translatable part of the actuator. This renders it possible to shorten the translatable part of the actuator with respect to the length of the coil former of the inverted speaker disclosed in the above-mentioned GB-A 2 360 899 without reducing the effective axial displacement possibility of the movable body. This means that the coaxial loudspeaker according to the invention has a ratio between the height of the construction and the stroke of the movable part thereof which is very suitable for high-performance applications in structures of limited depth. In other words, the loudspeaker has only a limited axial dimension in spite of its three-dimensional diaphragm, so that it has a small built-in depth. The speaker is eminently suitable for use in subwoofer systems in which compact, shallow housings are desired or even required. Such conditions are plentifully present in the automotive field, where speakers are mounted into e.g. car doors and dashboards and even under seats.

It is preferred to provide the loudspeaker according to the invention with both a first flexible connecting means proximate to the top part of the diaphragm and a second flexible connecting means proximate to the base part of the diaphragm for movably supporting the translatable body with respect to the chassis. Preferably, the first connecting means is fixed to the chassis and the diaphragm, and the second connecting means is fixed to the chassis and the bridging element.

It is noted that an additional drawback of the speaker disclosed in the above-mentioned GB-A 2 360 899 is that the limited available space within the diaphragm makes it difficult to build a powerful electromagnetic actuator which complies with high load requirements. Particularly the thermal load of the magnetic material of the magnetic structure of the actuator is a limiting factor. Notably with modern magnetic materials, such as neodymium-iron-boron alloys, the maximum allowable temperatures are relatively low.

This drawback can be removed or at least substantially reduced in the loudspeaker according to the invention if the bridging element is designed such that it functions as a cooling element during operation. In this context a thermally conductive material, such as a metal, e.g. aluminum, is an essential parameter. An embodiment of the loudspeaker in accordance with the invention has the feature that the bridging element is a thermally conductive disc-shaped element. Due to the direct connection between the movable part of the actuator and the disc-shaped bridging element, heat generated in the actuator during operation is given off to the surroundings via the disc-shaped element. Consequently, the temperature in the actuator remains relatively low during use. It has been found that the temperature remains within limits, set for the use of modern magnetic materials, even in the case of high powers.

In a practical embodiment of the loudspeaker according to the invention, the stationary actuator part comprises a magnetic structure and the translatable actuator part comprises a magnetic coil—also referred to as voice coil—, the magnetic coil extending into the air gap. The magnetic structure comprises a permanent magnet and usually a soft-magnetic yoke. During operation, an electrical current is flowing through the coil for generating, in co-operation with the magnetic field of the permanent magnet, an axial force for driving the movable body. It is inevitable that the electrical current also generates heat in the coil. However, if use is made of the cooling element of the kind described above, the coil temperature remains relatively low—also in the case of high loads—and only a limited transfer of heat to the other parts of the actuator, such as the permanent magnet, takes place. Thus a favorable thermal balance is warranted. This offers, moreover, the opportunity to make use of a multilayer voice coil in order to realize high BL-values, in spite of a limited coil diameter. As it is assumed that the term BL-value is generally known to those skilled in those art, the term is not explained here. Reference is made e.g. to Leo L. Beranek, Acoustics, ISBN 0-88318-494-X, pages 70 to 75.

In another embodiment of the loudspeaker, the disc-shaped element is provided with at least one tuning opening. Such an opening or openings may be used for tuning the mass of the entire movable structure of the loudspeaker. This relatively easy tuning widens the manufacturing tolerances for the other components of the movable structure, particularly the diaphragm, and thus reduces the manufacturing cost of the loudspeaker. The tuning opening or openings may also be used for tuning the mechanical Q-factor of the actuator. It is also assumed that this factor, which is related to the counteracting mechanical forces of the construction, is generally known to those skilled in the art, and for this reason the Q-factor is not explained here. Reference is made e.g. to Leo L. Beranek, Acoustics, ISBN 0-88318-494-X pages 183 to 200. The friction resistance acting on the bridging element during operation can be adjusted so as to improve the Q-factor, in dependence on the size of the tuning opening or openings.

An embodiment of the loudspeaker is characterized in that the cooling element has an anodized cooling surface. This feature gives the cooling element an improved heat-radiating capacity. A suitable metal for the cooling element is aluminum.

The invention also relates to a loudspeaker unit comprising the electrodynamic loudspeaker according to the invention and a housing accommodating the loudspeaker. The loudspeaker unit may form part of a compact subwoofer system in which the loudspeaker can be subjected to a high load. The loudspeaker according to the invention occupies only a limited space in the housing, which maybe formed by a car door or portion thereof or by another suitable mechanical structure of a car. High powers of the order of for example, about 300 watts are possible.

It is noted in relation to the claims that various combinations of characteristic features defined in the claims are possible.

The above-mentioned and other aspects of the invention are apparent from and are elucidated, by way of non-limitative examples, with reference to the embodiments described hereinafter.

Figure 2:
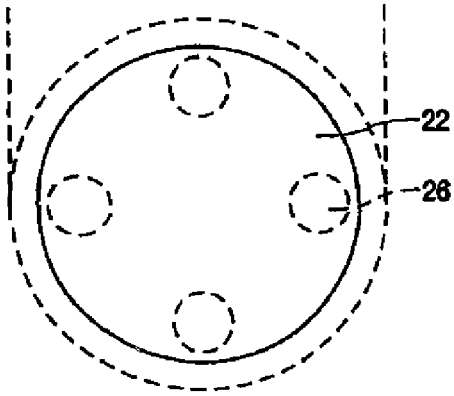
Figure 3:
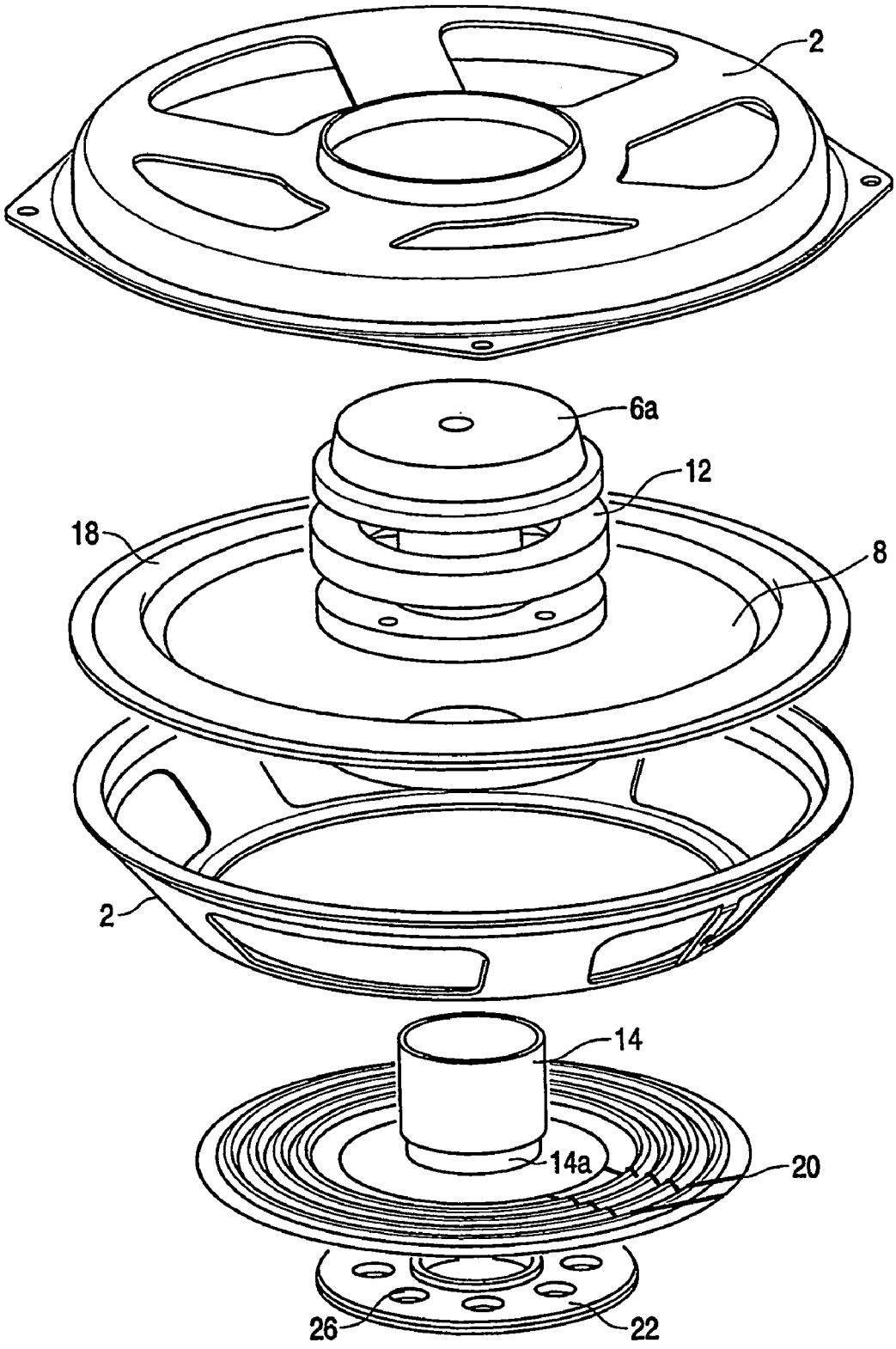

In the drawings:

FIG. 1 shows an embodiment of the loudspeaker according to the invention in a diagrammatic cross-section, FIG. 2 is a view taken along arrow A of an essential component of the loudspeaker shown in FIG. 1, and FIG. 3 is a perspective exploded view of the loudspeaker of FIG. 1.

The electrodynamic loudspeaker according to the invention shown in the Figures comprises a chassis 2, in this example comprising two chassis parts, a movable body 4, and an electromagnetic actuator 6. For forming a loudspeaker unit according to the invention, the loudspeaker may be accommodated in a housing. To this end, the chassis 2 of the loudspeaker may be fixed in an appropriate opening in a wall of the housing. In FIG. 1, the housing is shown diagrammatically as a wall section 1 in broken lines. The translatable body 4 comprises a three-dimensional diaphragm 8, in this example a conical diaphragm, which is situated at least partly in the chassis 2. The diaphragm 8 has a relatively wide top part 8*a* and a relatively narrow base part 8*b*. The contours of the diaphragm bound and define an inner space 9. The function of the electromagnetic actuator 6 is to displace the body 4 along a translation axis 10, which is the central axis of the loudspeaker and extends in a direction from the top part 8*a* to the base part 8*b*, or vice versa The actuator 6 essentially comprises two elements, namely a stationary actuator part 6*a* which is fixed to the chassis 2 and a translatable actuator part 6*b* which is connected to the translatable body 4 and is situated in or at least mainly in the space 9 enveloped by the contours of the diaphragm 8. One of the actuator parts—in this example the part 6*a*—is provided with a permanent magnet 12, in this example annular in shape and axially polarized, and the other actuator part—in this example the part 6*b*—is provided with a magnet coil 14. When the coil 14 is energized, the two actuator parts 6*a*, 6*b* magnetically cooperate with each other across an air gap 16 for generating a driving force on the translatable body 4 parallel to the translation axis 10 and hence on the diaphragm 8 forming part thereof. The permanent magnet 12 is formed from an neodymium-iron-boron alloy and forms a magnetic yoke with soft iron portions of the stationary actuator part 6*a*, which yoke defines the air gap 16 in this example. The magnet coil 14, being a cylindrical coil, also referred to as voice coil, is situated on a coil support 14*a*, which is a sleeve in this example and is fixed to the translatable body 4.

The depicted coaxial loudspeaker is provided with a flexible connection for the translatable body 4 and hence for the diaphragm 8. This flexible connection comprises a first flexible connecting means 18 proximate to the top part 8*a* of the diaphragm 8 and a second flexible connecting means 20 proximate to the base part 8*b* of the diaphragm 8. The flexible connection is to ensure that the body 4, and thus the diaphragm 8, can perform well-defined translation movements with respect to the chassis 2.

The first flexible connection means 18 has a roll structure know per se and formed from, for example, a bent rubber or foam annular rim which is secured, for example glued, by its outer circumference to the chassis 2 and by its inner circumference to the membrane 8. In this example, the second flexible connecting means 20 has a flexible corrugated member known per se, which is secured by its outer circumference to the chassis 2.

The loudspeaker according to the invention is provided with a bridging element 22 secured to the coil support 14*a* of the translatable actuator part 6*b*. In the depicted example, the bridging element 22 is a disc-shaped element which is made for cooling purposes from a thermally well-conductive material, e.g. aluminum, copper. The plate-shaped bridging element 22 has been secured to the coil support 14*a*, by means of e.g. soldering, glueing or another suitable process. The bridging element 22 is perpendicularly oriented with respect to the translation axis 10 and hence with respect to the sleeve-shaped coil support 14*a* and thus extends in a radial direction with respect to the translation axis 10 and the coil support 14*a* The diaphragm 8 of the loudspeaker is shaped such that it can be fastened, e.g. glued, by its rim 8*b*1 to an edging section 22*a* of the bridging element 22.

Owing to this measure, the connection between the diaphragm 8 and the translatable actuator part 6*b* is effected via the bridging element 22, the fastening of the diaphragm 8 to the bridging element 22 being at a radial distance to the translatable actuator part 6*b*. This feature leads to favorable mutual positions of the diaphragm 8 and the stationary actuator part 6, in the sense that the space 24 between the rim 8*a* of the diaphragm 8 and the oppositely located portion of the stationary actuator part 6*a* can be optimally used for translating the actuator part 6*b*.

The second flexible connecting means 20 mentioned above is in this embodiment secured by its inner circumference to the edging section 22*a* of the bridging element 22.

As is shown in FIG. 2, the bridging element 22 may be optionally provided with tuning openings 26 for e.g. mass tuning and/or tuning of the Q-factor of the loudspeaker. In order to improve the cooling effect of the bridging element 22, the element 22 may have an anodized cooling surface.

It is to be noted that the invention is not limited to the embodiment shown. For example, the diaphragm may have a shape which differs from the cone shape. Moreover, the loudspeaker unit may not only comprise one or more loudspeakers according to the invention, but also one or more bass reflex ports and/or one or more passive radiators. Furthermore, the loudspeakers are not limited to a certain power.

The invention claimed is:

1. An electrodynamic loudspeaker comprising:

a chassis, a movable body flexibly connected to the chassis and having a three-dimensional diaphragm with a base part and a top part that is wider than the base part, and an electromagnetic actuator for moving the body with respect to the chassis along a translation axis, which actuator includes:

a stationary actuator part secured to the chassis and located above the diaphragm, and a translatable actuator part extends inside a space defined by the diaphragm and is translatable along the translation axis with respect to the stationary actuator part and is connected to the movable body in the region of the base part of the diaphragm, the stationary and translatable actuator parts magnetically co-operating with each other across an air gap, wherein the movable body includes, in the proximity of the base part of the diaphragm, a bridging element that is secured to the movable part of the actuator and extends radially with respect to the translation axis, the diaphragm and the bridging element being interconnected at least at a radial distance to the translatable part of the actuator.

2. The loudspeaker of claim 1, wherein the bridging element functions as a cooling element during operation.

3. The loudspeaker of claim 1, wherein the bridging element includes a thermally conductive disc-shaped element.

4. The loudspeaker of claim 1, wherein the stationary actuator part includes a magnetic structure and the translatable actuator part includes a magnetic coil, the magnetic coil extending into the air gap.

5. The loudspeaker of claim 3, wherein the disc-shaped element includes at least one tuning opening.

6. The loudspeaker of claim 2, wherein the cooling element includes an anodized cooling surface.

7. The loudspeaker of claim 1, including a first flexible connecting means proximate to the top part of the diaphragm and a second flexible connecting means proximate to the base part of the diaphragm for movably supporting the translatable body with respect to the chassis, and wherein:

the first flexible connecting means is fixed to the chassis and the diaphragm, and the second flexible connecting means is fixed to the chassis and the bridging element.

8. The loudspeaker of claim 1, including a housing.

9. The loudspeaker of claim 2, wherein the bridging element includes a thermally conductive disc-shaped element.

10. The loudspeaker of claim 9, wherein the disc-shaped element is provided with at least one tuning opening.

11. A loudspeaker comprising:

a chassis, an actuator that includes a stationary actuator part secured to the chassis and located above the diaphragm, and a translatable actuator part that is configured to move along a translation axis relative to the chassis, a bridging element that is coupled to the translatable actuator part and extends radially from the translation axis, a diaphragm that includes:

a top part that is coupled to the chassis, and a base part that is coupled to the bridging element at a radial distance from the translatable actuator part to provide a diameter of the base part that is significantly larger than a diameter of the translatable actuator part.

12. The loudspeaker of claim 11, including a housing that encloses the chassis and diaphragm.

13. The loudspeaker of claim 11, wherein the stationary actuator part comprises a magnetic structure, and the translatable actuator part includes a coil that is configured to move the actuator along the translation axis via an interaction with the magnetic structure.

14. The loudspeaker of claim 13, wherein the coil is located within a gap that separates the magnetic structure from the translatable actuator part.

15. The loudspeaker of claim 11, wherein the bridging element includes a thermally conductive disc-shaped element.

16. The loudspeaker of claim 11, wherein the bridging element includes at least one tuning opening.

17. The loudspeaker of claim 11, wherein the bridging element includes an anodized cooling surface.

18. The loudspeaker of claim 11, wherein the bridging element is configured to conduct heat from the actuator.

19. The loudspeaker of claim 11, including a flexible member that couples the bridging element to the chassis and is configured to support the bridging element and translatable actuator part relative to the chassis.

20. The loudspeaker of claim 18, including a flexible member that couples the top part of the diaphragm to the chassis.

21. An electrodynamic loudspeaker comprising:

a chassis, a movable body flexibly connected to the chassis and having a three-dimensional diaphragm with a base part and a top part that is wider than the base part so that the diaphragm has a substantially conical shape, and an electromagnetic actuator for moving the body with respect to the chassis along a translation axis, which actuator includes:

a stationary actuator part secured to the chassis on an inwardly conical side of the diaphragm, and a translatable actuator part that extends inside a space defined by the diaphragm and is translatable along the translation axis with respect to the stationary actuator part and is connected to the movable body in the region of the base part of the diaphragm, the stationary and translatable actuator parts magnetically co-operating with each other across an air gap, wherein the movable body includes, in the proximity of the base part of the diaphragm, a bridging element that is secured to the movable part of the actuator and extends radially with respect to the translation axis, the diaphragm and the bridging element being interconnected at least at a radial distance to the translatable part of the actuator.

* * * * *